US010563873B2

(12) United States Patent
Lai et al.

(10) Patent No.: US 10,563,873 B2
(45) Date of Patent: Feb. 18, 2020

(54) AUTOMATIC CONTROL DRAINING DEVICE AND A HUMIDIFIER USING THE SAME

(71) Applicant: SHENZHEN LIANCHUANG TECHNOLOGY GROUP CO., LTD., Shenzhen (CN)

(72) Inventors: Banlai Lai, Shenzhen (CN); Yapeng Pang, Shenzhen (CN)

(73) Assignee: SHENZHEN LIANCHUANG TECHNOLOGY GROUP CO., LTD., Shenzhen (CN)

( * ) Notice: Subject to any disclaimer, the term of this patent is extended or adjusted under 35 U.S.C. 154(b) by 125 days.

(21) Appl. No.: 15/844,503

(22) Filed: Dec. 15, 2017

(65) Prior Publication Data

US 2019/0072289 A1 Mar. 7, 2019

(30) Foreign Application Priority Data

Sep. 4, 2017 (CN) ..... 2017 1 0787658

(51) Int. Cl.

| | |
|---|---|
| ***F24F 6/04*** | (2006.01) |
| ***F24F 3/14*** | (2006.01) |
| ***B01F 3/04*** | (2006.01) |
| *F24F 6/00* | (2006.01) |

(52) U.S. Cl.

CPC ..... *F24F 6/04* (2013.01); *B01F 3/04* (2013.01); *F24F 3/14* (2013.01); *F24F 2006/008* (2013.01)

(58) Field of Classification Search

CPC ..... F24F 6/04; F24F 3/14; B01F 3/04

See application file for complete search history.

(56) References Cited

U.S. PATENT DOCUMENTS 1,469,963 A * 10/1923 Sartakoff ..... H01M 2/362 137/260

* cited by examiner

*Primary Examiner* — Robert A Hopkins

(74) *Attorney, Agent, or Firm* — Liang Legal Group, PLLC

(57) ABSTRACT

An automatic control draining device, which is disposed in a sink, includes a float chamber, fixed in the sink and having a lower portion in communication with the sink; a floater, disposed in the float chamber and provided with a first valve stem at an upper end thereof; and a first valve seat, disposed above the float chamber and having a drain outlet formed at an upper portion thereof and a concave surface formed at a lower portion thereof, wherein the concave surface is in communication with the drain outlet; when the floater floats up in the float chamber, an end of the first valve stem contacts the concave surface to form a sealing fit. The draining device moves up and down with the level of water to drive the first valve stem to contact or separate from the concave surface to control the level of water in the sink.

3 Claims, 7 Drawing Sheets

AUTOMATIC CONTROL DRAINING DEVICE AND A HUMIDIFIER USING THE SAME

CROSS-REFERENCE TO RELATED APPLICATIONS

This disclosure is based upon and claims priority to Chinese Patent Application No. 201710787658.5, filed on Sep. 4, 2017, and the entire contents of which are incorporated herein by reference.

TECHNICAL FIELD

The present invention relates to an air humidity control device, in particular relates to an automatic control draining device and a humidifier using the same.

BACKGROUND

With continuous improvement of people's quality of life, air humidity control device (hereinafter referred to as "humidifier") is popular with consumers for its function of humidifying dry air, compensating for moisture in the air, improving living comfort and moisturizing the skin. In a dry season, the humidifier has become a common household appliance in modern life, especially the regular use of air-conditioned rooms and dry areas such as the Northwest. An existing humidifier usually has an extractable independent water tank, and a smart valve is installed on the bottom of the water tank. When in use, it is necessary to lift up the water tank and rotate it by 180 degrees, in order to inject water, turn on the control valve, inject water from the control valve port, turn off the control valve, and place the humidifier back to the base, in order for normal use. This is inconvenient operation procedures, because the water tank can be very heavy after having water added. It is inconvenient for infirm persons such as the elderly and the women to use. Meanwhile, because the diameter of the control valve port is limited, it is difficult for the hand to be inserted in water tank, and the cleaning of the internal space of the water tank is inconvenient. To solve this problem, technicians have invented a humidifier that allows water to be added therein from the top of the tank. For example, the electric control devices, such as an electromagnetic valve, a water pump, and a motor are disposed on the humidifier base. However, these devices are expensive and have complicated circuit, resulting in high cost of the humidifier.

SUMMARY

One objective of the present invention is to provide an automatic control draining device, which has relatively low production cost of the complete machine, as compared with the prior art that uses an electronic control device to inject water from the top.

In order to achieve the objective, a technical solution is provided as follows:

In one aspect, embodiments of the present invention provide an automatic control draining device, which is disposed in a sink, comprising: a float chamber, fixed in the sink and having a lower portion in communication with the sink; a floater, disposed in the float chamber and provided with a first valve stem at an upper end of the floater; and a first valve seat, disposed above the float chamber 121 and having a drain outlet formed at an upper portion thereof and a concave surface formed at a lower portion thereof; wherein the concave surface is in communication with the drain outlet; when the floater floats up in the float chamber, an end of the first valve stem contacts with the concave surface to form a sealing fit.

The end of the first valve rod may have a spherical surface structure, and the concave surface of the first valve seat may be a tapered surface, a top of which is communicated with the drain outlet. When the floater floats up in the float chamber, a spherical end face of the first valve stem contacts the tapered surface to form a sealing fit.

The floater may be made of a material with a density less than water or with a hollow sealed structure, and the floater is able to move up and down along an inner side of the float chamber under the effect of buoyancy of the water in the sink.

The floater may be a foam board (or a similar material) with a density less than water.

The first valve stem may be vertically fixed to a middle portion of the floater along a buoyancy direction of the floater.

In another aspect, embodiments of the present invention provide a humidifier, comprising a base, having a sink formed therein, and a water tank, mounted on the base and having a draining pipe disposed at a bottom thereof; wherein, any one of the abovementioned automatic control draining device is disposed in the sink, and the water tank is an upper open water tank, the drain pipe and the draining device have a drain valve disposed therebetween; when the water tank is separated from the base, the drain valve closes the drain pipe, and when the water tank is connected with from the base, the drain valve opens the drain pipe to allow the water in the water tank to enter the drain outlet through the drain pipe.

The drain valve may comprise a second valve stem and a second valve seat; the second valve seat may be disposed at an upper end of the first valve seat and in communication with the drain outlet. The second valve stem may have a post rod disposed at a middle portion thereof; and the second valve stem may be disposed in the drain pipe with a upper end thereof having a sealing ring disposed thereon. When the water tank is separated from the base, the second valve stem descends along the drain pipe and the sealing ring forms a sealing fit with the upper end face of the drain pipe. When the water tank is connected with the base, the drain pipe falls into the second valve seat and forms a sealing fit with the inner side of the second valve seat to allow the post rod to jack up the second valve stem. The sealing ring gets separated from an upper end face of the drain pipe, and the water in the water tank enters the drain outlet through the drain pipe.

The drain pipe may have a guide board disposed therein, and the second valve stem is disposed to extend through a middle portion of the guide board and forms a clearance fit with the guide board. The guide board has a drain hole formed thereon, a lower end face of the second valve stem has a jacking head disposed thereon; and the second valve stem disposed between the jacking head and the guide board has a compression spring sleeved thereon The technical solutions may have the following advantages:

1. in a draining device of the present invention, a first valve stem is disposed on the floater and a first valve seat is disposed above the float chamber in the sink. The end of the first valve stem is disposed to align with the concave surface on the lower end face of the first valve seat. When the level of water in the sink rises, the floater in the float chamber may also ascend and when the floater reaches a certain level, the upper end of the first valve stem may contact the concave surface to seal the drain outlet to stop draining. When the level of water in the sink drops, the floater may also descend, and when the first valve stem is separated from the drain outlet, the water may enter the sink from the drain pipe of the water tank. Embodiments of the invention provide a draining device that utilizes the upward and downward movement along with the movement of the water level to drive the first valve stem to contact and separate from the concave surface, so as to complete the draining of the automatic control water tank to control the level of water in the sink. An automatic control draining device of the present disclosure may have the advantages such as simple structure, simple art of production, low cost, low power consumption, energy saving and environmental protection.

2. In accordance with embodiments of the present invention, a draining device may be disposed in the base, which is convenient to dispose. Meanwhile, the disposal of a drain valve between the drain pipe of the water tank and the draining device may realize the removal of the water tank and the injection of water from the top. Then, the second valve stem in the drain valve automatically seals the drain pipe. When the water tank is connected with the base after the water tank is full of water, the second valve seat in the drain valve jacks up the first valve stem to open the drain pipe, so as to allow the water in the water tank to enter the drain outlet, thereby achieving the injection of water from the top of the humidifier after the water tank is removed. Alternatively, it is also possible to directly inject water from the top of the humidifier without removing the water tank from the base.
3. The humidifier of the prior art has a control valve disposed at the bottom thereof, which is connected with the base and controls the draining by means of the gas-pressure balance the internal gas pressure and the external gas pressure, so that no opening allows to be formed at the top of the water tank. In addition, before injection of water, it is necessary to lift the water tank and rotate by 180 degrees, turn on the control valve, inject water from the control valve port, turn off the control valve and place the humidifier back to the base, in order for the normal use, which is inconvenient in operation procedures, because the water tank can be very heavy after adding water. It is inconvenient for infirm persons such as the elderly and the women to use. Meanwhile, because the diameter of the control valve port is limited, it is difficult for the hand to be inserted in water tank, and the cleaning of the internal space of the water tank is inconvenient. A draining device in accordance with the present invention utilizes the principle of buoyancy to control the draining, and makes no demand for the internal gas pressure and the external gas pressure, so that an opening can be formed at the top of the water tank, when there is a need of injecting water or cleaning the internal space, it is only necessary to remove the lid at the opening, which is convenient in operation and improves the usability of product.

BRIEF DESCRIPTION OF THE DRAWINGS

In order to more clearly describe the technical solutions in the specific embodiments of the present invention or in the prior art, hereinafter the accompanying drawings required to be used in the description of the specific embodiments or the prior art will be briefly introduced. Apparently, the accompanying drawings described below are only directed to some embodiments of the present invention, and for those skilled in the art, without expenditure of creative labor, other drawings can be derived on the basis of these accompanying drawings.

Reference signs: 1—base; 11—sink; 12—draining device; 121—float chamber; 122—floaterl; 1221—first valve stem; 123—first valve seat; 1231—draining outlet; 1232—concave surface; 1233—water storage cavity; 13—atomizer; 2—water tank; 21—drain pipe; 211—guide board; 212—sealing sleeve; 22—drain valve; 211—second valve stem; 2211—sealing ring; 2212—jacking head; 2213—compression spring; 222—second valve seat; 2221—post rod; 2222—drain hole; 2223—communication port; 23—water supply port; 24—atomizer outlet;

DETAILED DESCRIPTION OF THE INVENTION

The technical solutions of the present invention will be described clearly and completely in conjunction with the appended drawings. Obviously, the embodiments described herein are only partial embodiments of the present invention, but not all the embodiments. Based on the embodiments of the present invention, the other embodiments that may be obtained by the persons having ordinary skill in the art without making creative effort should be considered falling into the protection scope of the present invention.

Figure 1:
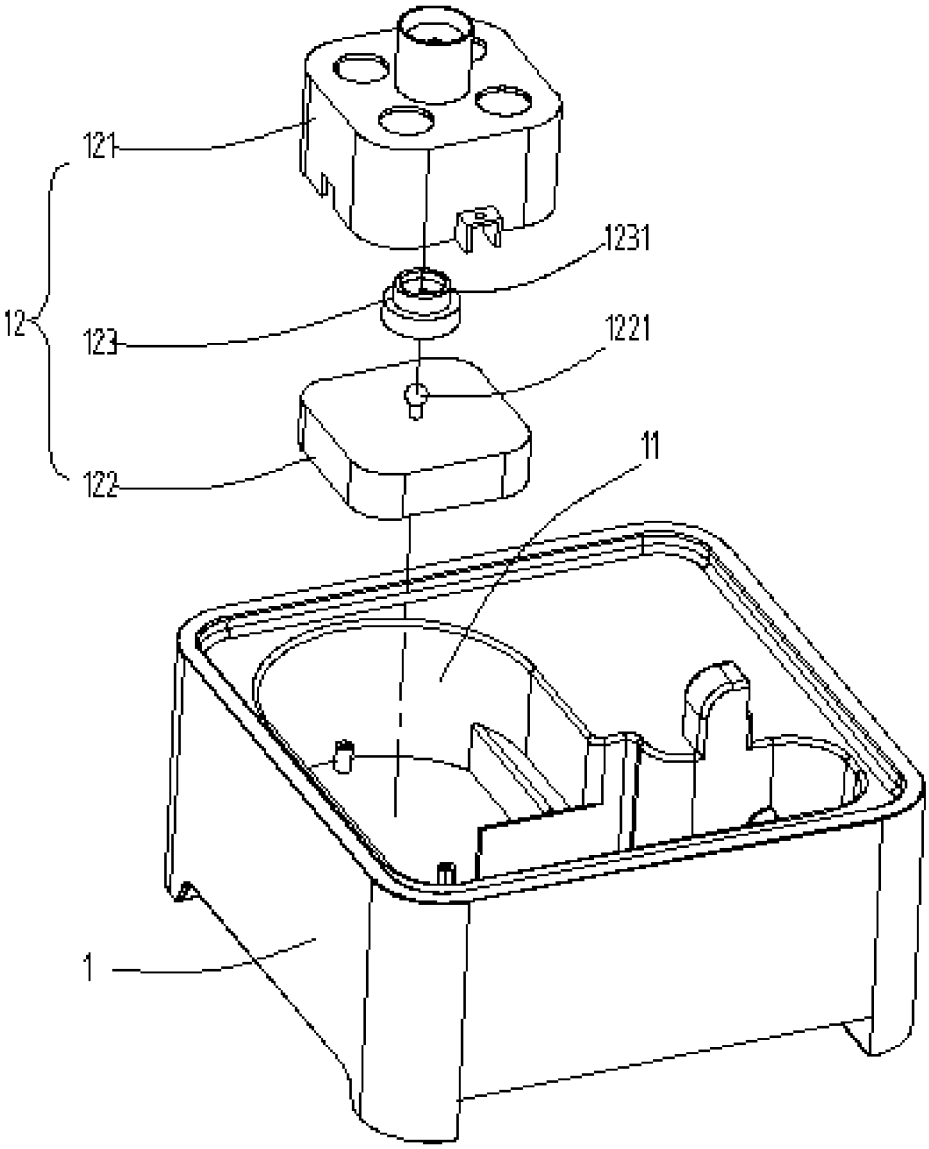
FIG. 1 shows a decomposition axonometric view of an automatic control draining device in accordance with one embodiment of the present invention.
Figure 2:
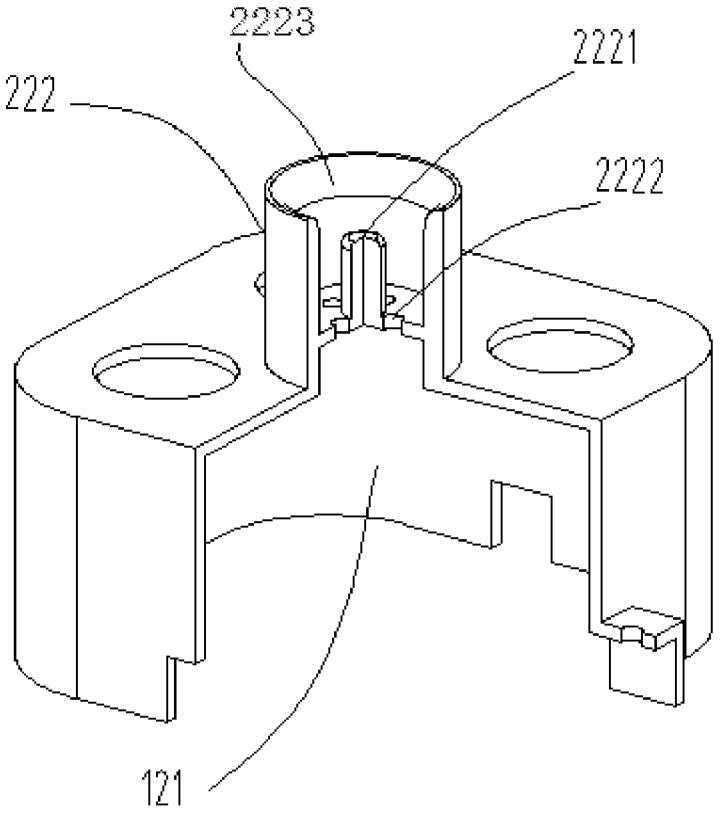
FIG. 2 shows a broken-out (expanded) sectional view of the float chamber of FIG. 1.
Figure 3:
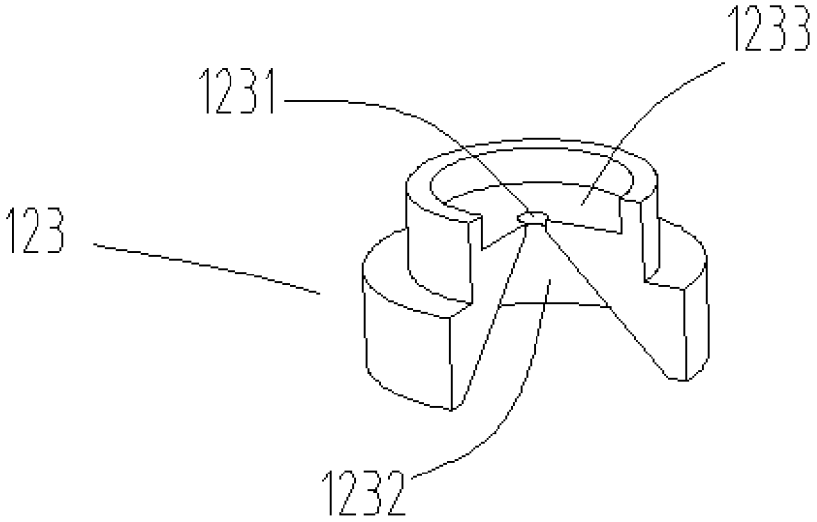
FIG. 3 shows a broken-out sectional view of the first valve seat of FIG. 1.

Referring to FIG. 1, embodiments of the invention provide an automatic control draining device, which is disposed in a sink 11, comprising a float chamber 121 fixed in the sink 11, a floater 122 and a first valve seat 123. Referring to FIG. 2, an opening is formed at a lower portion of the float chamber, which allows the internal space of the float chamber to be in communication with the sink 11. The floater 122 is disposed in the float chamber 121, a first valve stem 1221 is disposed at an upper end of the floater; and a first valve seat 123 is disposed on an upper end face of the float chamber 121. Referring to FIG. 1, the first valve seat 123 is disposed at the upper portion of the inner side of the float chamber. Referring to FIG. 3, the first valve seat 123 has a drain outlet 1231 formed at an upper portion thereof, and a concave surface 1232 formed at a lower portion thereof; wherein, the concave surface 1232 is in communication with the drain outlet 1231; when the floater 12 floats in the float chamber 121 under the effect of buoyancy of the water, an end of the first valve stem 1221 contacts with the concave surface 1232 to form a sealing fit, so as to block the water. In this embodiment. The float chamber may have an opening formed on the upper end thereof, or have no opening formed on the upper end thereof.

The end of the first valve rod 1221 is a spherical surface structure, a semi-spherical surface structure, or a sector structure; and the concave surface 1232 of the first valve 123 seat is a tapered surface, a top of which is communicated with the drain outlet 1231, and when the floater 122 floats in the float chamber 121, a spherical end face of the first valve stem 1221 contacts with the tapered surface to form a sealing fit, so as to seal the drain outlet form on the first valve seat. On the contrary, the descending of the floater may cause the separation of the first valve stem 1221 from the first valve seat 123 to open the drain outlet, so as to allow the water to enter the sink 11 through the drain outlet. The floater 122 is disposed in the float chamber and can be moved up and down, while the first valve stem 1221 always stay in a conical area.

Embodiments of the invention provide a draining device that utilizes the upward and downward movement along with the movement of the level of water to drive the first valve stem to contact with and separate from the concave surface, so as to complete the draining of the automatic control water tank to control the level of water in the sink. An automatic control draining device of the present invention has the advantages such as simple structure, simple art of production, low cost, low power consumption, energy saving and environmental protection.

The floater 122 is preferably a foam board or made of a material with a density less than water, or has a hollow structure, which allows the floater to float in the water. The floater 122 may move up and down along an inner side of the float chamber 121 under the effect of buoyancy of the water in the sink 11.

In addition, referring to FIG. 4 to FIG. 8, an embodiment of present invention provides a humidifier, comprising a base 1 having a sink 11 and an atomizer disposed therein, and a water tank 2 mounted on the base 1 and having a draining pipe 21 disposed at a bottom thereof and in communication therewith; wherein, an automatic control draining device 12 is disposed in the sink, and the water tank is an upper open water tank, water can be injected through an water inlet 23 on the upper portion of the water tank. The water in the sink is atomized by the atomizer and sprayed out of the atomizer outlet. Meanwhile, the drain pipe 21 and the draining device 12 have a drain valve 22 disposed therebetween; when the water tank 2 is separated from the base 1, the drain valve 22 closes the drain pipe 21, on the contrary, when the water tank is connected with the base, the drain valve 22 opens the drain pipe 21 to allow the water in the water tank to enter the drain outlet 1231 through the drain pipe 21. The draining device controls the draining of the drain outlet 1231 according to the level of water in the sink.

Figure 4:
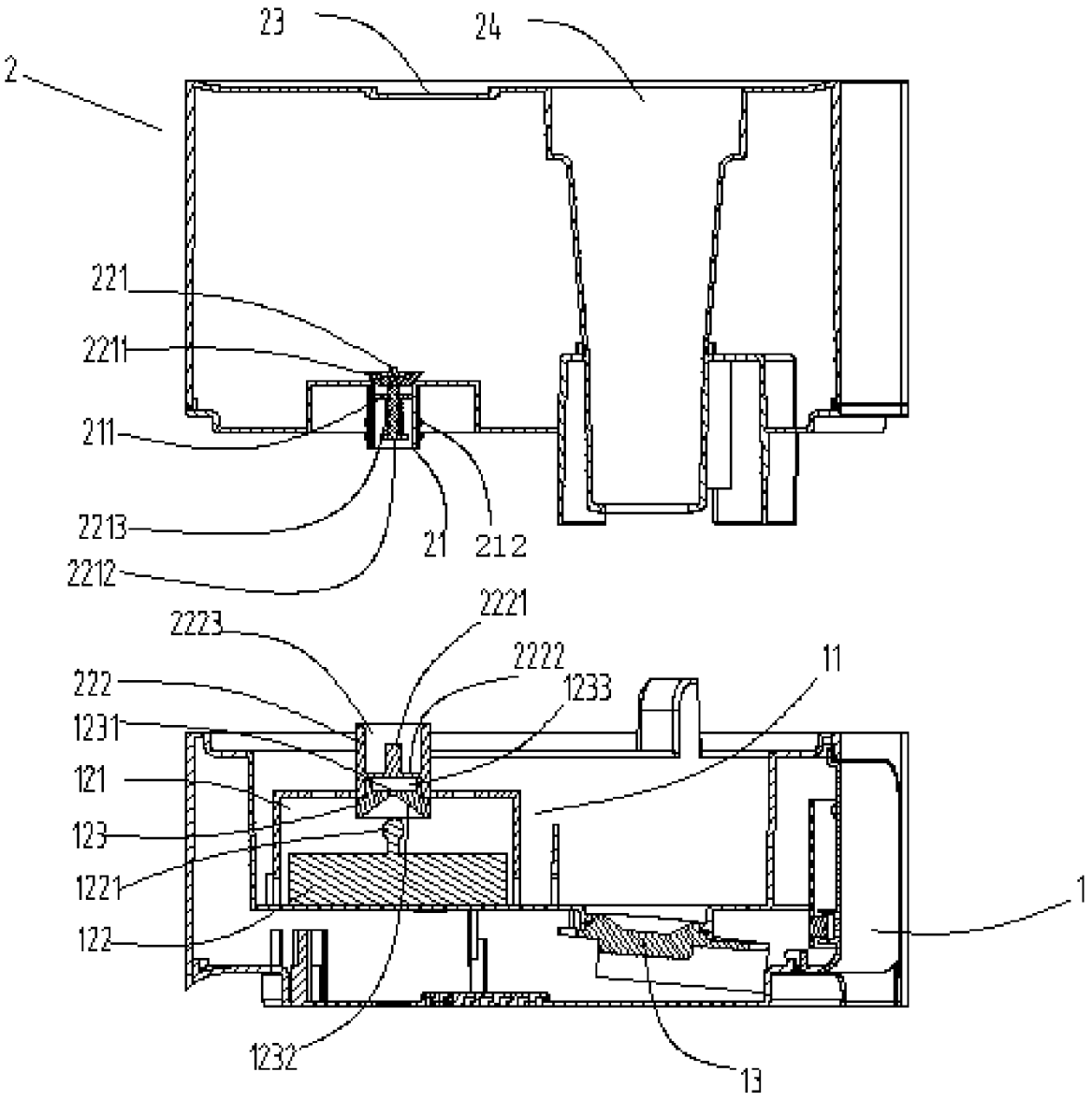
FIG. 4 shows a front sectional view that shows the separate installation of the water tank and the base in accordance with one embodiment of the present invention.
Figure 5:
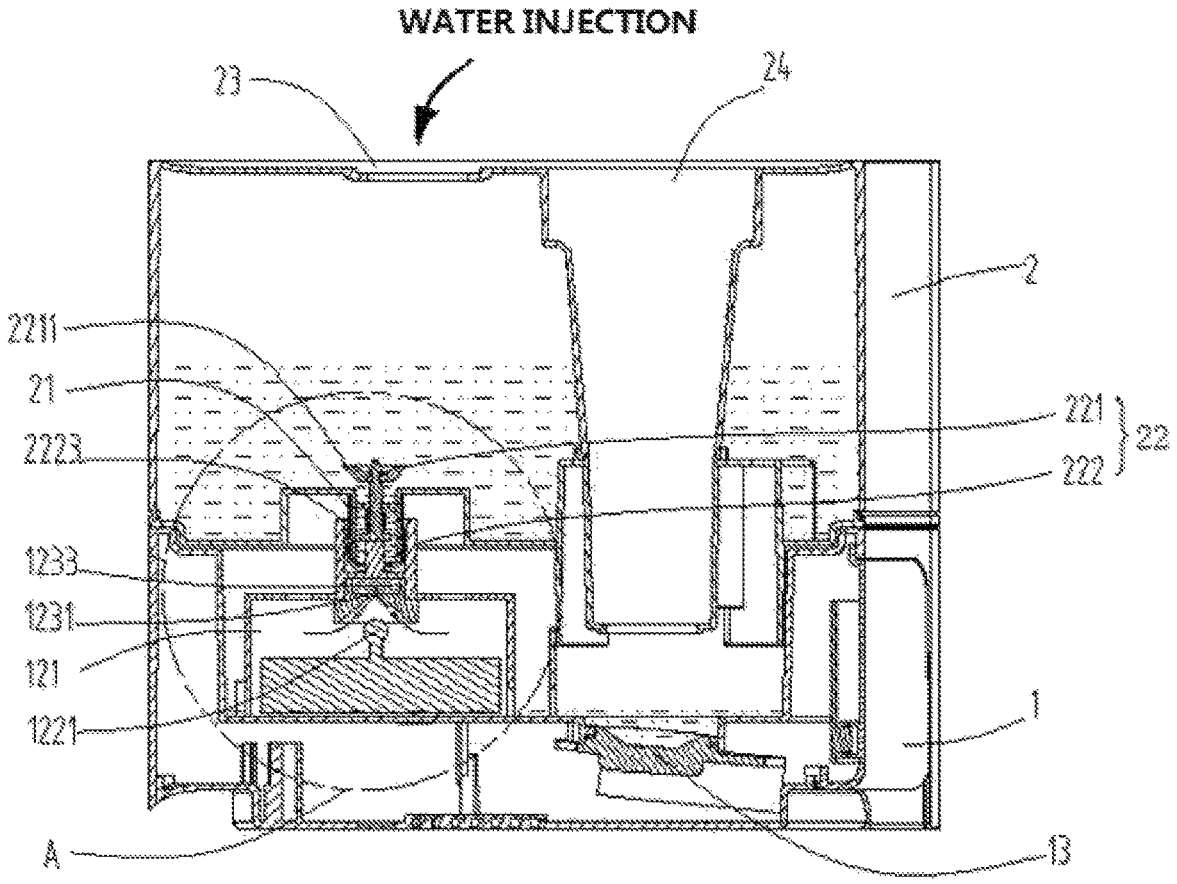
FIG. 5 shows a structural view of a humidifier in accordance with one embodiment of the present invention at the draining state.

The drain valve 22 of an embodiment of the present invention, as illustrated in FIG. 4 and FIG. 5, comprises a second valve stem 221 and a second valve seat 222; the second valve seat 222 is disposed at an upper end of the first valve seat 123 and in communication with the drain outlet, wherein the second valve seat 222 is welded with the first valve seat 123, or fastened on the first valve seat 123 in a sealing manner. A communication port 2223, in communication with the drain outlet, is disposed on the upper portion of the second valve seat 222, and the lower end of the drain pipe 21 is placed in the communication port 223 and forms a sealing connection with the communication port 223 through a sealing sleeve sleeved on the drain pipe. Referring to FIG. 4, the second valve stem has a post rod 2221 disposed at a middle portion in an axial direction thereof; and drain holes 2222 are disposed surrounding the post rod 2221, as illustrated in FIG. 2. The second valve stem 221 is disposed in the drain pipe 21 with a upper end thereof having a sealing ring 2211 disposed thereon.

Referring to FIG. 4, when the water tank 2 is separated from the base 1, the second valve stem 221 descends along the drain pipe 21 and the sealing ring 2211 forms a sealing fit with the upper end face of the drain pipe 21.

Referring to FIG. 5, when the water tank 2 is connected with the base 1, the drain pipe 21 fails into the communication port 2223 of the second valve seat 222 and forms a sealing fit with the inner side of the second valve seat 222 to allow the post rod 2221 to jack up the second valve stem 221. The sealing ring 2211 gets separated from an upper end face of the drain pipe 21 and the water in the water tank 2 enters the drain pipe 21 and further enters the drain outlet 1231 through the drain holes 2222.

The drain pipe 21 has a guide board 211 disposed therein, and the second valve stem 221 is disposed to extend through a middle portion of the guide board 211 and forms a clearance fit with the guide board 211, i.e. the second valve stem 221 can make upward and downward movement along the guide board. Through holes are disposed surrounding the guide board 211, which allows the water in the drain pipe to enter a water storage cavity 1233 of the first valve seat through the through holes; a lower end face of the second valve stem 221 has a jacking head 2212 disposed thereon; and the second valve stem 221 disposed between the jacking head 2212 and the guide board 211 has a compression spring 2212 sleeved thereon.

The second valve stem 221 can make upward and downward movement through the compression spring 2212; a sealing sleeve 212 is sleeved on an external wall of the drain pipe of the water tank 2 and fixed thereto. The sealing sleeve 212 forms a sealing fit with the communication port 2223 of the second valve seat 222, and is extractable in movable manner.

Figure 6:
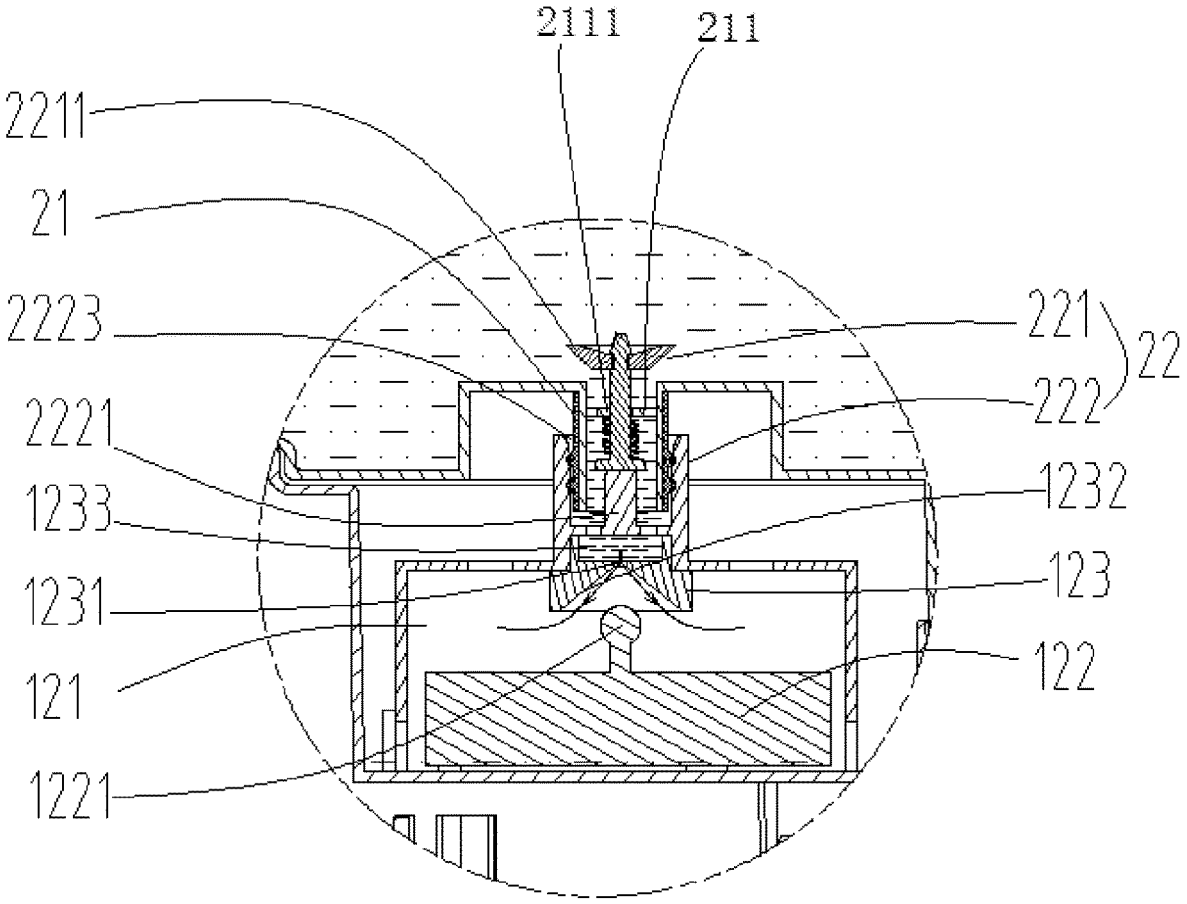
FIG. 6 shows a magnified view of part A of FIG. 5 (draining state)
Figure 7:
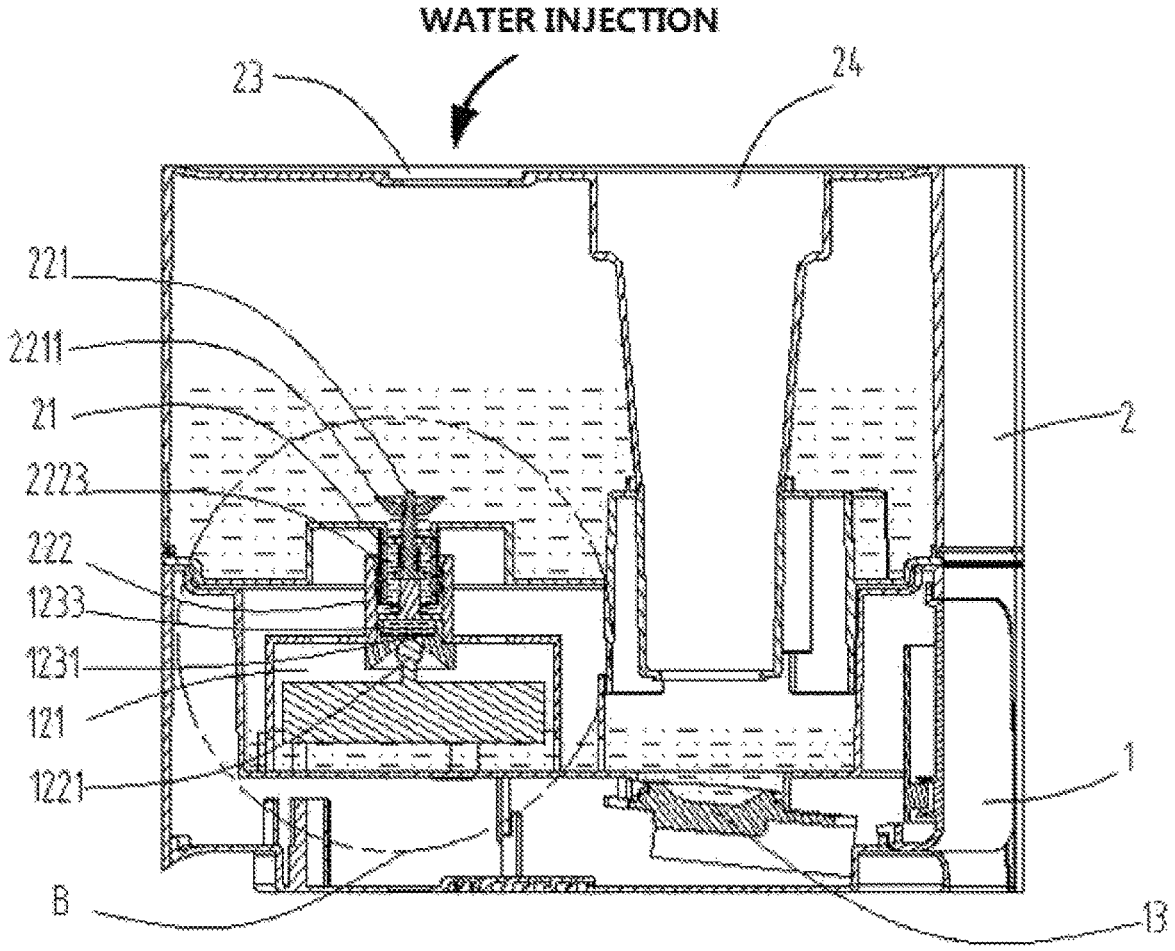
FIG. 7 shows a structural view of a humidifier in accordance with one embodiment of the present invention at the sealing state.
Figure 8:
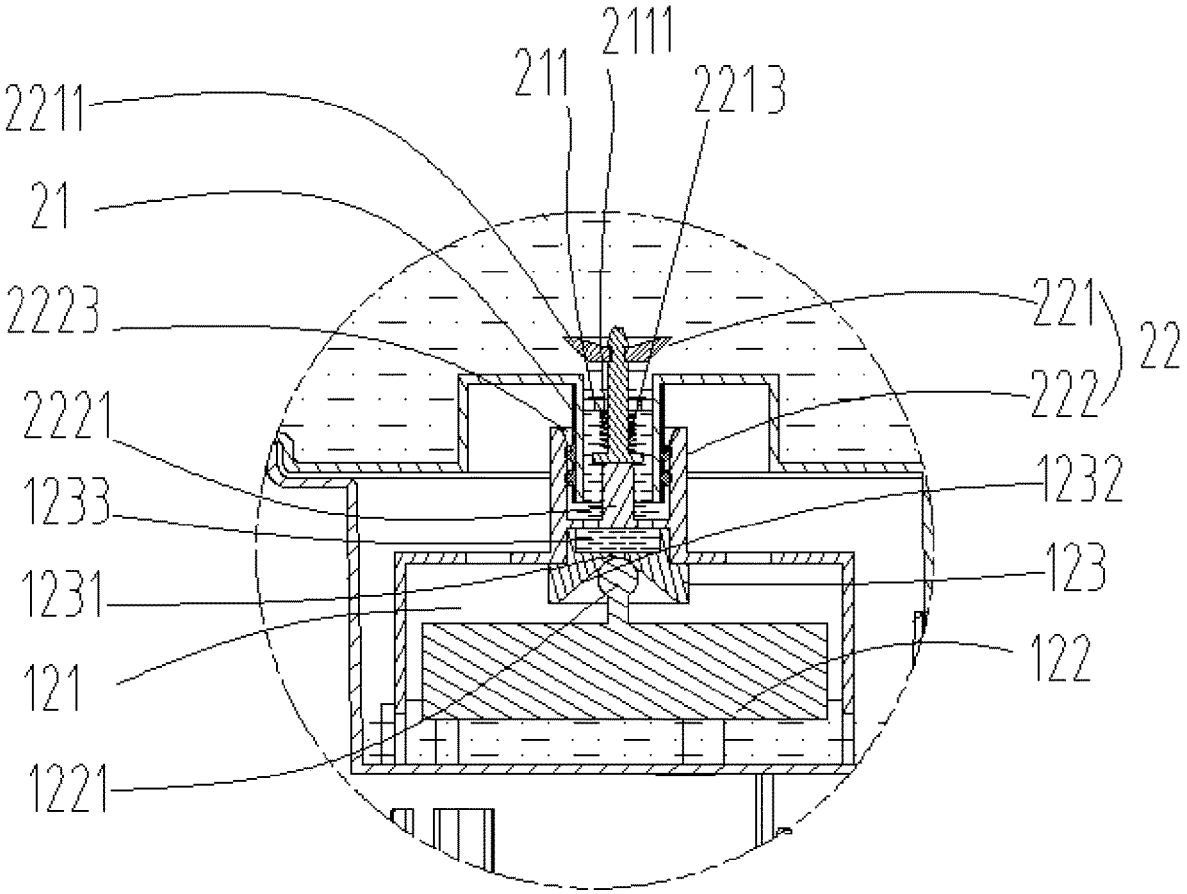
FIG. 8 is a magnified view of part B of FIG. 7 (sealing state)

A water tank of an embodiment of the present invention aligns with the communication port and is inserted in the communication port, and the atomizer outlet 24 aligns the upper portion of the atomizer 13, the water tank 2 is disposed on the base 1 and the second valve stem 221 is jacked up by the post rod 2221, and the sealing ring 2211 leaves the water inlet 23, as illustrated in FIG. 5 and FIG. 6, at this time, water is injected from the water inlet 23 of the water tank and enters the water storage cavity 1233 through the water inlet 23 and the drain holes 2222. The water in the water storage cavity 1233 enters the sink 11 through the drain outlet 1231, which causes the level of water in the sink and the floater to rise, when a certain level of water is reached, the first valve stem 1221 on the floater 122 contacts with the conical surface, and seals the drain outlet 1231 to stop draining, as illustrated in FIG. 7 and FIG. 8. Meanwhile, the atomizer 13 starts to work and the level of water in the sink 11 may descend along with the working of the atomizer 13, and the floater 122 may also descend along with the descending of level of water, the first valve stem 1221 leaves the conical surface and water is drained again from the drain outlet 1231. The floater 122 may make upward and downward movement along with the ascending and descending of level of water, so as to drive the first valve step 1221 to separate from and engage with the conical surface to achieve the automatic control over the draining of the water tank, thereby controlling the level of water in the sink 11.

The above described is just preferred embodiments of the present invention, and is not intended to limit the present invention. For those skilled in the art, the present invention can have various changes and modifications. Any changes, equivalent substitutions, modifications etc. made within the concept and principle of present invention should be embraced within the protection scope of the present invention.

What is claimed is:

1. A humidifier, comprising:

a base, having a sink formed therein; and a water tank, mounted on the base and having a drain pipe disposed at a bottom thereof;

wherein an automatic control draining device is disposed in the sink, wherein the automatic control draining device comprises:

a float chamber, fixed in the sink and having a lower portion in communication with the sink;

a floater, disposed in the float chamber and provided with a first valve stem at an upper end thereof; and a first valve seat, disposed at an upper part of the float chamber, wherein a drain outlet forms at an upper portion of the first valve seat and a concave surface formed at a lower portion of the first valve seat, wherein the concave surface is in communication with the drain outlet when the floater floats up in the float chamber, an end of the first valve stem contacts the concave surface to form a sealing fit, and the water tank is an upper open water tank, the drain pipe and the automatic control draining device have a drain valve disposed therebetween; when the water tank is separated from the base, the drain valve closes the drain pipe, and when the water tank is connected with the base, the drain valve opens the drain pipe to allow water in the water tank to enter the drain outlet through the drain pipe.

2. The humidifier according to claim 1, wherein the drain valve comprises a second valve stem and a second valve seat; the second valve seat is disposed at an upper end of the first valve seat and in communication with the drain outlet; the second valve stem has a post rod disposed at a middle portion thereof; and the second valve stem is disposed in the drain pipe with an upper end thereof having a sealing ring disposed thereon;

when the water tank is separated from the base, the second valve stem descends along the drain pipe and the sealing ring forms a sealing fit with the upper end face of the drain pipe;

when the water tank is connected with the base, the drain pipe falls into the second valve seat and forms a sealing fit with the inner side of the second valve seat such that the post rod jacks up the second valve stem, the sealing ring gets separated from an upper end face of the drain pipe and the water in the water tank enters the drain outlet through the drain pipe.

3. The humidifier according to claim 2, wherein the drain pipe has a guide board disposed therein, and the second valve stem is disposed to extend through a middle portion of the guide board and forms a clearance fit with the guide board; the guide board has a drain hole formed thereon, a lower end face of the second valve stem has a jacking head disposed thereon; and the second valve stem disposed between the jacking head and the guide board has a compression spring sleeved thereon.

* * * * *